US010054075B1

(12) United States Patent
Marrack et al.

(10) Patent No.: US 10,054,075 B1
(45) Date of Patent: Aug. 21, 2018

(54) ELECTRIC FUEL PUMP UNINTERRUPTED POWER SUPPLY

(71) Applicant: Caterpillar Inc., Peoria, IL (US)

(72) Inventors: Andrew Marrack, Peoria, IL (US); Scott Shafer, Morton, IL (US)

(73) Assignee: Caterpillar Inc., Deerfield, IL (US)

( * ) Notice: Subject to any disclaimer, the term of this patent is extended or adjusted under 35 U.S.C. 154(b) by 22 days.

(21) Appl. No.: 15/423,864

(22) Filed: Feb. 3, 2017

(51) Int. Cl.
*F02D 41/30* (2006.01)
*F02M 39/02* (2006.01)
*F02D 41/24* (2006.01)

(52) U.S. Cl.
CPC ..... *F02D 41/3082* (2013.01); *F02D 41/2406* (2013.01); *F02M 39/02* (2013.01)

(58) Field of Classification Search
CPC .. F02D 41/3082; F02D 41/2406; F02M 39/02
See application file for complete search history.

(56) References Cited

U.S. PATENT DOCUMENTS 4,777,793 A 10/1988 Weigand et al.
5,252,860 A 10/1993 McCarty et al.
7,397,363 B2 7/2008 Joao
7,560,881 B2 * 7/2009 Anson ..... F02C 7/232 123/495
7,602,140 B2 10/2009 Asaumi et al.
9,212,618 B2 12/2015 Sivasubramanian et al.
2005/0287880 A1 12/2005 Okuyama

FOREIGN PATENT DOCUMENTS

JP 4564935 B2 10/2010

* cited by examiner

*Primary Examiner* — Hung Q Nguyen
*Assistant Examiner* — Xiao Mo
(74) *Attorney, Agent, or Firm* — Miller, Matthias & Hull

(57) ABSTRACT

A fuel system for a machine is disclosed. The fuel system may include a fuel pump, a pump motor configured to drive the fuel pump, and a pump controller. The pump controller may be operatively connected to the pump motor, a main battery bank of the machine via a power wire and a ground wire, and an engine controller of the machine via a communication wire. The pump controller may be configured to detect a failure of at least one of the communication wire, the power wire, and the ground wire. The pump controller may also be configured to adjust a power output and an operation of the pump motor based on the detected failure of at least one of the communication wire, the power wire, and the ground wire.

20 Claims, 4 Drawing Sheets

66

| Mode / Actions | Initiate Timer | Engage Backup Battery | High Power Output or Low Power Output | Open Loop Configuration or Closed Loop Configuration |
|---|---|---|---|---|
| Normal Operation Mode 68 | No | No | High Power Output | Closed Loop Configuration |
| Communication Wire Failure Mode 70 | Yes | No | High Power Output | Open Loop Configuration |
| Power Wire Failure Mode 72 | No | Yes | Low Power Output | Closed Loop Configuration |
| Ground Wire Failure Mode 74 | No | Yes | Low Power Output | Closed Loop Configuration |
| All Wires Failure Mode 76 | No | Yes | Low Power Output | Open Loop Configuration |

FIG. 3

ELECTRIC FUEL PUMP UNINTERRUPTED POWER SUPPLY

FIELD OF THE DISCLOSURE

The present disclosure relates generally to machines and, more particularly, to fuel systems for machines.

BACKGROUND OF THE DISCLOSURE

Machines, such as earthmoving and construction machines, typically include an engine configured to provide mechanical energy to the machine, such as to drive the machine and supply power to other components of the machine. Generally, a fuel system supplies fuel to the engine, which then transforms chemical energy from the fuel into mechanical energy. Kidney looping through filtration provides fuel cleanliness, as well as a longevity of high pressure components in fuel systems.

However, kidney looping has added complexity to the machines in the form of multiple electrically controlled pumps. These pumps may be located off of the engine for the benefit of fuel filtration. As a result, the pumps may require a wiring harness of a substantial length in order to allow remote mounting of the pumps relative to the engine. Failure of the wiring harness may result in an unexpected engine shutdown and loss of power to the machine.

A power source device is disclosed in U.S. Patent Application Publication No. 2005/0287880, entitled, "Power Source Device for Boat." In the 2005/0287880 reference, the power source device is provided with a propulsion battery for supplying power to engine-related components of an outboard motor and an auxiliary battery for supplying power to boat accessories. In order to maintain stabilized operation of the engine, electric power from the auxiliary battery is supplied to the engine-related components when a charged voltage of the propulsion battery drops below a charged voltage of the auxiliary battery so that power to the engine-related components is supplemented.

While arguably effective, there is still a need for a robust functionality of electric low pressure fuel systems in the event of wiring harness failure.

SUMMARY OF THE DISCLOSURE

In accordance with one aspect, a fuel system for a machine is disclosed. The fuel system may include a fuel pump, a pump motor configured to drive the fuel pump, and a pump controller. The pump controller may be operatively connected to the pump motor, a main battery bank of the machine via a power wire and a ground wire, and an engine controller of the machine via a communication wire. The pump controller may be configured to detect a failure of at least one of the communication wire, the power wire, and the ground wire. The pump controller may also be configured to adjust a power output and an operation of the pump motor based on the detected failure of at least one of the communication wire, the power wire, and the ground wire.

In accordance with another aspect, a machine is disclosed. The machine may include an engine, an engine controller operatively connected to the engine, a main battery bank operatively connected to the engine controller and operatively charged by the engine, and a fuel system in operative communication with the engine. The fuel system may include a backup battery, a fuel pump operatively configured to deliver pressurized fuel to the engine, a pump motor powered primarily by the main battery bank and configured to drive the fuel pump, and a pump controller.

The pump controller may be operatively connected to the backup battery, the pump motor, the engine controller via a communication wire, and the main battery bank via a power wire and a ground wire. The pump controller may be configured to: detect a failure of at least one of the communication wire, the power wire and the ground wire, engage the backup battery to supply power to the pump motor if the detected failure is associated with one of the power wire or the ground wire, and selectively adjust a power output and an operation of the pump motor based on the detected failure of at least one of the communication wire, the power wire, and the ground wire.

In accordance with another aspect, a method for controlling a fuel system of a machine in an event of a wiring harness failure is disclosed. The fuel system may include a backup battery, a fuel pump, a pump motor configured to drive the fuel pump, and a pump controller. The pump controller may be operatively connected to the backup battery, the pump motor, an engine controller of the machine via a communication wire, and a main battery bank of the machine via a power wire and a ground wire. The method may be performed by at least one of the pump controller and the engine controller.

The method may include detecting a communication wire failure; detecting a power wire failure; detecting a ground wire failure; and detecting an all wires failure. The method may also include upon detection of the communication wire failure, commanding a predetermined high power output to the pump motor, the predetermined high power output preprogrammed into a memory associated with the pump controller. The method may further include upon detection of one of the communication wire failure or the all wires failure, operating the pump motor in an open loop configuration in which the pump motor is set at a default speed preprogrammed into the memory associated with the pump controller.

The method may further include upon detection of the communication wire failure, initiating a timer preprogrammed into the memory associated with the pump controller. The method may also include upon detection of the communication wire failure, shutting down the pump motor after expiration of a timer. The method may further include upon detection of one of the power wire failure, the ground wire failure, or the all wires failure, engaging the backup battery to supply power to the pump motor.

The method may also include: upon detection of one of the power wire failure, the ground wire failure, or the all wires failure, commanding a predetermined low power output to the pump motor, the predetermined low power output being less than the predetermined high power output and preprogrammed into the memory associated with the pump controller; upon detection of one of the power wire failure or the ground wire failure, operating the pump motor in a closed loop configuration in which a speed of the pump motor is modified based on feedback indicative of an actual fuel pressure; and upon detection of one of the power wire failure or the ground wire failure, notifying the operator of the machine of a battery life of the backup battery.

BRIEF DESCRIPTION OF THE DRAWINGS

FIG. 3 is a chart illustrating various modes of operation for an electric fuel pump of the fuel system of FIG. 2, in accordance with another aspect.

While the present disclosure is susceptible to various modifications and alternative constructions, certain illustrative embodiments thereof will be shown and described below in detail. The disclosure is not limited to the specific embodiments disclosed, but instead includes all modifications, alternative constructions, and equivalents thereof.

DETAILED DESCRIPTION

Figure 1:
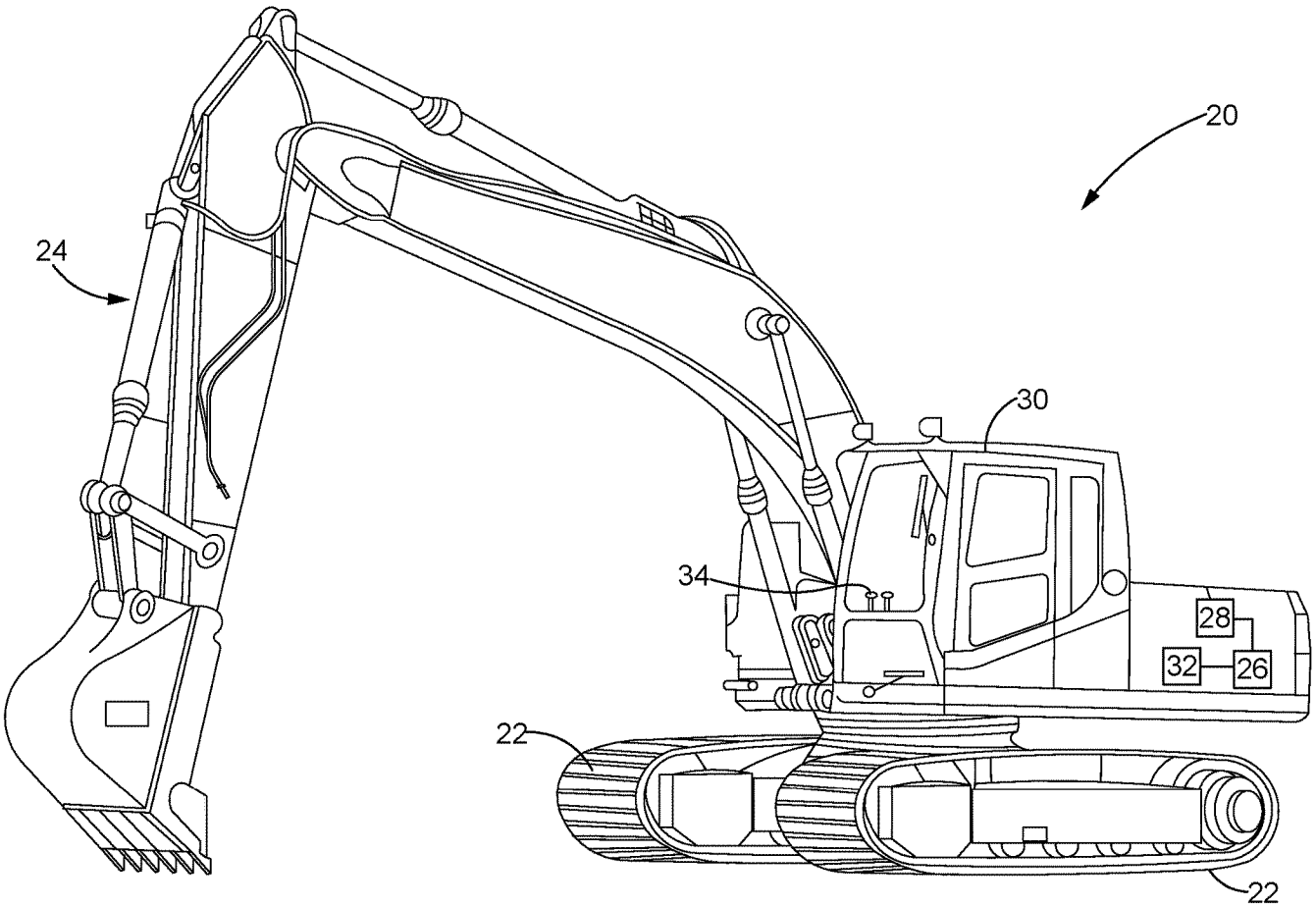
FIG. 1 is a perspective view of a machine, according to one aspect.

Referring now to the drawings, and with specific reference to FIG. 1, a machine consistent with certain embodiments of the present disclosure is generally referred to by reference numeral 20. Generally, corresponding reference numbers will be used throughout the drawings to refer to the same or corresponding parts. It is to be understood that although the machine 20 is illustrated as a hydraulic excavator, the machine 20 may be of many other types. As used herein, the term "machine" refers to a mobile or stationary machine that performs a driven operation involving physical movement associated with a particular industry, such as, earthmoving, construction, landscaping, forestry, transportation, agriculture, mining, etc.

Non-limiting examples of machines include commercial and industrial machines, such as, excavators, loaders, earthmoving vehicles, dozers, motor graders, tractors, backhoes, trucks, mining vehicles, on-highway vehicles, trains, generator sets, agricultural equipment, material handling equipment, and other types of machines that operate in a work environment. It is to be understood that the machine 20 is shown primarily for illustrative purposes to assist in disclosing features of various embodiments, and that FIG. 1 does not depict all of the components of a machine.

The machine 20 may include traction devices 22, an implement assembly 24, an engine 26 or other power source, a fuel system 28, and an operator cab 30. Although traction devices 22 are shown as tracks, traction devices 22 may be wheels or of any other type. The engine 26 may provide mechanical power to a hydraulic system 32, which is configured to drive and control the traction devices 22 and the implement assembly 24. The operator cab 30 may contain an operator interface 34, which may be configured to receive input from and output data to an operator of the machine 20. The operator interface 34 may include a plurality of operator controls, such as buttons, joysticks, and levers, for controlling operation of the machine 20.

Figure 2:
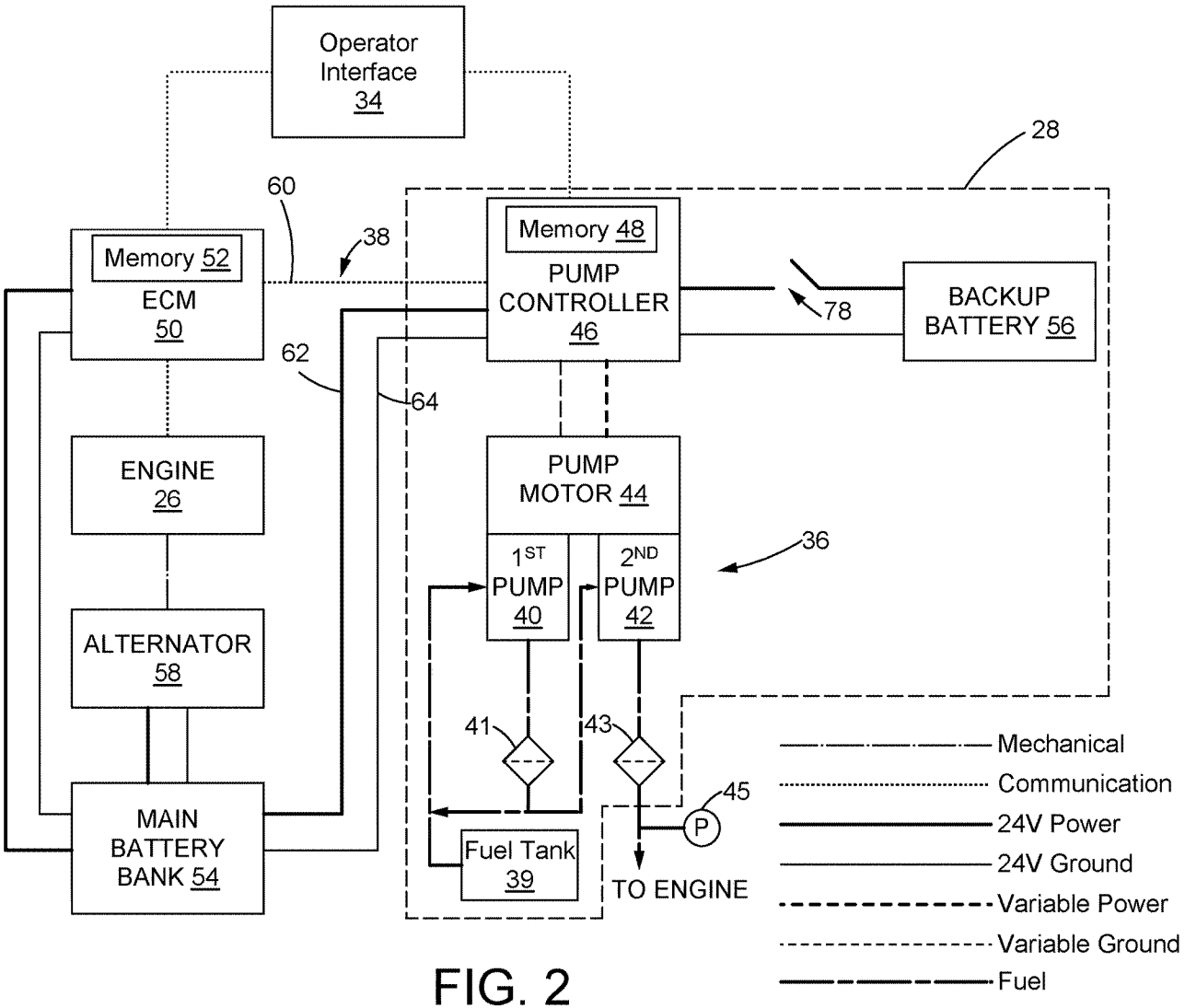
FIG. 2 is a schematic view of a fuel system of the machine of FIG. 1, in accordance with another aspect.

Turning now to FIG. 2, with continued reference to FIG. 1, the fuel system 28 is operatively configured to supply fuel to the engine 26, which transforms chemical energy from the fuel into mechanical energy. For example, the fuel system 28 may include a kidney loop filtration system, or other type of filtration system, having at least one electrically controlled pump 36. The at least one pump 36 may be located off of the engine 26 for fuel filtration, such as in a kidney loop. A wire harness 38 of substantial length may be needed to facilitate remote mounting of the at least one pump 36 relative to the engine 26.

In one example, the at least one pump 36 may include a first electric fuel pump 40 configured to circulate the fuel around the kidney loop filtration system and a second electric fuel pump 42 configured to pressurize the fuel from a tank 39 to the engine 26. For instance, the second electric fuel pump 42 may deliver pressurized fuel to the engine 26. More specifically, the second electric fuel pump 42 may generate a pressurized flow of fuel to injectors, which may then inject the fuel into the engine 26. In addition, fuel from the first electric fuel pump 40 may pass through a first filter 41, and fuel from the second electric fuel pump 42 may pass through a second filter 43. However, other configurations for the at least one pump 36 may be used. Furthermore, features of the fuel system 28 disclosed herein may apply to other systems than fuel systems, as well as to other electrically controlled or electrically powered actuators than fuel pumps. For example, the at least one pump 36 may comprise one or more diesel exhaust fluid pumps, oil pumps, coolant pumps, and/or any other type of pump or actuator.

The fuel system 28 may further include a pump motor 44 operatively connected to the at least one pump 36 and a pump controller 46 operatively connected to the pump motor 44. The pump motor 44 may comprise an electric motor and may be configured to drive the at least one pump 36. In an example, the pump motor 44 may comprise a brushless direct current (DC) motor, although other types of motors may be used. Configured to convert electrical energy into mechanical energy, the pump motor 44 may be located off of the engine 26 proximate to the at least one pump 36. For instance, the pump motor 44 may energize each of the first electric fuel pump 40 and the second electric fuel pump 42.

In operative communication with the operator interface 34, the pump motor 44, an engine controller 50, a main battery bank 54, and a backup battery 56, the pump controller 46 may be configured to control the pump motor 44, and therefore, an output of the at least one pump 36. In an example, the pump controller 46 may be onboard the pump motor 44. However, other arrangements may be used for the pump controller 46.

The pump controller 46 may be implemented using one or more of a processor, a microprocessor, a microcontroller, a digital signal processor (DSP), a field-programmable gate array (FPGA), an electronic control module (ECM), an electronic control unit (ECU), and a processor-based device that may include or be associated with a non-transitory computer readable storage medium having stored thereon computer-executable instructions, or any other suitable means for electronically controlling functionality of the pump motor 44, the at least one pump 36, and the fuel system 28.

The pump controller 46 may be configured to operate according to predetermined algorithms or sets of instructions for operating the fuel system 28. Such algorithms or sets of instructions may be programmed or incorporated into a memory 48 that is associated with or at least accessible to the pump controller 46. The memory 48 may be provided within and/or external to the pump controller 46 and may comprise a non-volatile memory. It is understood that the pump controller 46 may include other hardware, software, firmware, and combinations thereof.

Operatively connected to the engine 26, the pump controller 46, and the operator interface 34, the engine controller 50 may be configured to electronically control functionality of the engine 26. For example, the pump controller 46 may be connected to the engine controller 50 through the wire harness 38, such as via one or more communication wires 60. Similar to the pump controller 46, the engine controller 50 may comprise a processor-based device, or any other suitable means. The engine controller 50, may include or be associated with a non-transitory computer readable storage medium, such as a memory 52, having stored thereon computer-executable instructions.

The main battery bank 54 may be operatively connected to the engine 26, the pump controller 46, and the engine controller 50. For instance, the pump controller 46 may be connected to the main battery bank 54 through the wire harness 38, such as via a power wire 62 and a ground wire 64. The main battery bank 54 may comprise a plurality of batteries configured to provide power to the engine controller 50, the pump controller 46, the pump motor 44, and the at least one pump 36, as well as to other engine accessories. For example, an alternator 58 may be connected to the engine 26 and the main battery bank 54. The alternator 58 may be configured to convert mechanical energy from the engine into electrical energy to charge the main battery bank 54.

The backup battery 56 may be operatively connected to the pump controller 46, and may be configured to provide an uninterrupted power supply to the pump controller 46, the pump motor 44, and the at least one pump 36 in the event the power wire 62, the ground wire 64, or the entire wire harness 38 fails. In so doing, the backup battery 56 may provide power to the at least one pump 36 in order to operate the engine 26 for a sufficient period of time to allow an operator of the machine 20 to safely shut down the machine 20. Thus, even when power from the main battery bank 54 is cut off, such as through a wiring failure, the fuel system 28 may still be able to provide uninterrupted power to the at least one pump 36 and deliver fuel to the engine 26.

In one example, the backup battery 56 may comprise a lithium-ion battery, although other compositions for the backup battery 56 may be used. In addition, the backup battery 56 may be at an electrical system voltage of the machine 20, such as at twenty-four volts (24 V), thirty-six volts (36 V), or forty-eight volts (48V), although other voltages may be used. However, different types of batteries may be used for the backup battery 56. Furthermore, the backup battery 56 may be rechargeable. For instance, after the wiring failure is repaired, the pump controller 46 may be configured to recharge the backup battery 56 by supplying power from the main battery bank 54 to the backup battery 56.

INDUSTRIAL APPLICABILITY

Referring now to FIG. 3, with continued reference to FIGS. 1 and 2, a chart illustrating various modes 66 of operation for the at least one pump 36 is shown, in accordance with another aspect. Features of the various modes 66 of operation may be preprogrammed into the memory 48 of the pump controller 46, as well as into the memory 52 of the engine controller 50. For example, during a normal operation mode 68 of the machine 20, each of the communication wire 60, the power wire 62, and the ground wire 64 may be functional without any wiring failures. During the normal operation mode 68, the pump controller 46 may be configured to operate the pump motor 44 at a high power output in a closed loop configuration.

In the normal operation mode 68, the pump controller 46 is receiving power from the main battery bank 54 via the power wire 62 and the ground wire 64. Therefore, the pump controller 46 may be configured to deliver power from the main battery bank 54 to the pump motor 44 at the high power output. More specifically, a predetermined high power output may be preprogrammed into the memory 48 of the pump controller 46. For instance, the predetermined high power output may comprise a desired power output of a relatively high value that is commanded to the pump motor 44, which thereby causes the at least one pump 36 to operate at a high speed and provide a high fuel pressure.

Furthermore, in the normal operation mode 68, the pump controller 46 is receiving a communication signal from the engine controller 50 via the communication wire 60. Therefore, the pump controller 46 may receive the communication signal to modify a speed of the pump motor 44 in the closed loop configuration. More specifically, in the closed loop configuration, operation of the at least one pump 36 is regulated by feedback from the engine controller 50. For example, the engine controller 50 may be configured to receive feedback indicative of an actual fuel pressure, such as from one or more pressure sensors 45 (FIG. 2) configured to detect a pressure of the fuel.

Based on the actual fuel pressure from the pressure sensors 45, the engine controller 50 may determine a desired speed for the at least one pump 36 in order to achieve a desired fuel pressure. The communication signal may include a signal indicative of the desired speed for the at least one pump 36 and may be sent to the pump controller 46 via the communication wire 60. The pump controller 46 may then command the pump motor 44 to operate at a speed that correlates to the desired speed for the at least one pump 36 commanded by the engine controller 50. In this closed loop configuration, the engine controller 50 and the pump controller 46 may continue to adjust the speed of the at least one pump 36 based on the received feedback from the pressure sensors 45 until the desired fuel pressure is achieved. Furthermore, in the normal operation mode 68, the at least one pump 36 is shut down when the engine controller 50 sends an engine power stop command over the communication wire 60.

Each of the pump controller 46 and the engine controller 50 may be configured to detect various wire failures, such as failures of the communication wire 60, the power wire 62, the ground wire 64, and all the wires 60, 62, 64. For instance, each of the pump controller 46 and the engine controller 50 may measure a current and/or a voltage of the communication wire 60, the power wire 62, and the ground wire 64, and if the measured current and/or the voltage drops to zero, a failure may be detected. Based on which wire(s) failed, the pump controller 46 may enter a different mode of operation than the normal operation mode 68. For example, the pump controller 46 may be configured to selectively engage the backup battery 56 and selectively adjust a power output and an operation of the pump motor 44 based on the type of wire failure that was detected.

For a communication wire failure mode 70, the pump controller 46 may detect a failure of the communication wire 60. The power wire 62 and the ground wire 64 may be functional, and the communication wire 60 may by inoperative in the communication wire failure mode 70. For instance, the pump controller 46 may determine that it is no longer receiving the desired speed command from the engine controller 50, thereby detecting the communication wire failure. During the communication wire failure mode 70, the pump controller 46 is still receiving power from the main battery bank 54 via the power wire 62 and the ground wire 64. Therefore, similar to the normal operation mode 68, the pump controller 46 may be configured to deliver power from the main battery bank 54 to the pump motor 44 at the high power output.

However, since the pump controller 46 is no longer receiving the communication signal from the engine controller 50 via the communication wire 60, the pump controller 46 may be configured to operate the pump motor 44 in an open loop configuration. In the open loop configuration, the pump motor 44 is set to a default speed. The default speed may be preprogrammed into the memory 48 associated with the pump controller 46. For example, the default speed may be predetermined based on several factors of the fuel system 28, such as a safe fuel pressure range for the fuel system 28, a regulation of the fuel system 28, a pump displacement, and an engine consumption. In the open loop configuration, the pump controller 46 may run the pump motor 44 at the default speed until the at least one pump 36 is shut down.

Furthermore, upon detection of the communication wire failure, the pump controller 46 may be configured to initiate a timer preprogrammed into the memory 48 associated with the pump controller 46. The pump controller 46 may be configured to operate the pump motor 44 at the default speed for a predetermined time period until expiration of the timer. The predetermined time period may be determined based on the type of machine 20. For instance, the predetermined time period may be thirty minutes for a mining truck or ten minutes for a generator set, although other predetermined time periods may be used. When the timer expires, the pump controller 46 may be further configured to shut down the pump motor 44 and the at least one pump 36.

In addition, the engine controller 50 may be configured to detect the communication wire failure. For example, the engine controller 50 may receive a communication signal via the communication wire 60 from the pump controller 46, such as a signal indicative of an actual speed of the pump motor 44. The engine controller 50 may determine that it is no longer receiving this signal, thereby detecting the communication wire failure. For example, each of the engine controller 50 and the pump controller 46 may have a communication protocol wherein each controller acknowledges receipt of a message. If a message is sent, and there is no acknowledgment after a predetermined number of cycles, each controller may determine a disconnection of the communication wire 60 or a communication wire failure.

In addition, the engine controller 50 may detect the at least one pump 36 is operating in the open loop configuration based on feedback from pressure sensors and temperature sensors. However, the engine controller 50 may utilize other ways to detect the communication wire failure. Upon detection of the communication wire failure, the engine controller 50 may also be configured to initiate a timer preprogrammed into the memory 52 of the engine controller 50. A predetermined time period for the timer may be identical to that associated with the pump controller 46.

The engine controller 50 may be configured to send signals to the operator interface 34 in order to notify the operator of the machine 20 of the communication wire failure, the initiation of the timer, and/or an elapsed time of the timer until the at least one pump 36 and the machine 20 is shut down. In one example, the engine controller 50 may be configured to display a notification of the communication wire failure via a light, such as a "check engine" light or similar indication, on the operator interface 34, as well as via a screen wherein a visual message of the notification may be displayed. However, other configurations and operator controls of the operator interface 34 may be used for notifying the operator of the machine of the communication wire failure.

For a power wire failure mode 72, the pump controller 46 may be configured to detect a failure of the power wire 62. The communication wire 60 and the ground wire 64 may be functional, and the power wire 62 may be inoperative in the power wire failure mode 72. For instance, the pump controller 46 may determine that it is no longer receiving power from the main battery bank 54, such as if the pump controller 46 measures zero voltage from the main battery bank 54, thereby detecting the power wire failure.

During the power wire failure mode 72, the pump controller 46 is no longer receiving power from the main battery bank 54. Therefore, the pump controller 46 may be configured to engage the backup battery 56 to supply power to the pump motor 44. Furthermore, since the communication wire 60 is still intact during the power wire failure mode 72, the pump controller 46 may be further configured to send a signal to the engine controller 50 indicative of a battery life of the backup battery 56 via the communication wire 60.

In the power wire failure mode 72, the engine controller 50 may be configured to notify the operator of the machine 20 of the power wire failure, as well as the battery life via the operator interface 34. For instance, the engine controller 50 may display the battery life of the backup battery 56 through at least one of a percentage and a visual icon on the screen of the operator interface 34. However, other configurations and operator controls of the operator interface 34 may be used for notifying the operator of the machine 20 of the power wire failure and/or the battery life of the backup battery 56.

Moreover, in the power wire failure mode 72, the pump controller 46 may be configured to operate the pump motor 44 at a low power output in the closed loop configuration. Since the backup battery 56 is delivering power to the pump motor 44, the low power output may preserve the battery life of the backup battery 56 in order to allow the operator of the machine 20 to safely park the machine 20 and shut down the at least one pump 36. A predetermined low power output may be preprogrammed into the memory 48 of the pump controller 46. For instance, the predetermined low power output may comprise a desired power output of a relatively low value that is commanded to the pump motor 44, which thereby causes the at least one pump 36 to operate at a low speed and provide a low fuel pressure.

The predetermined low power output is substantially less than the predetermined high power output. In an example, if the predetermined high power output causes the at least one pump 36 to provide the high fuel pressure of 100 psi, the predetermined low power output may cause the at least one pump 36 to provide the low fuel pressure of 75 psi. However, other numerical values for the high fuel pressure and the low fuel pressure may be used. Furthermore, the predetermined high power output and the predetermined low power output may be electrical current limits in the pump controller 46 instead of fuel pressures. In addition, since the pump controller 46 is still receiving the communication signal from the engine controller 50 via the communication wire 60, the pump controller 46 may still regulate the speed of the pump motor 44 based on feedback from the engine controller 50 in the closed loop configuration.

For a ground wire failure mode 74, the pump controller 46 may detect a failure of the ground wire 64. The communication wire 60 and the power wire 62 may be functional, and the ground wire 64 may be inoperative in the ground wire failure mode 74. For example, the pump controller 46 may measure zero voltage from the main battery bank 54, thereby detecting a failure of one of the ground wire 64 or the power wire 62.

The ground wire failure mode 74 may be similar to the power wire failure mode 72 in every action. For example, the pump controller 46 may be configured to engage the backup battery 56 to supply power to the pump motor 44 during the ground wire failure mode 74. In addition, the pump controller 46 may be configured to send a signal to the engine controller 50 indicative of the battery life of the backup battery 56 via the communication wire 60, and the engine controller may be configured to notify the operator of the machine 20 of the ground wire failure and/or the battery life of backup battery 56 in the ground wire failure mode 74. Furthermore, during the ground wire failure mode 74, the pump controller 46 may be configured to operate the pump motor 44, and thereby the at least one pump 36, at the lower power output in the closed loop configuration.

For an all wires failure mode 76, the pump controller 46 may be configured to detect a failure of all of the wires, such as a failure of each of the communication wire 60, the power wire 62, and the ground wire 64. The entire wire harness 38, including each of the communication wire 60, the power wire 62, and the ground wire 64, may be inoperative in the all wires failure mode 76. For instance, the pump controller 46 may determine that it is no longer receiving the communication signal from the engine controller 50, no longer receiving power from the main battery bank 54, and measuring zero voltage from the main battery bank 54.

During the all wires failure mode 76, the pump controller 46 may be configured to engage the backup battery 56 to supply power to the pump motor 44. Furthermore, the pump controller 46 may be configured to operate the pump motor 44 at the low power output in the open loop configuration. In addition, the engine controller 50 may be configured to detect the all wires failure and notify the operator of the machine 20 of the all wires failure via the operator interface 34.

For instance, the engine controller 50 may determine that it is no longer receiving signals from the pump controller 46, and that the at least one pump 36 is operating in the open loop configuration based on feedback from pressure sensors and temperature sensors. Moreover, upon detection of the all wires failure, the engine controller 50 may send signals to the operator interface 34 to notify the operator of the machine 20 of an impending shutdown, such as through a visual display on the screen or an audio message from a speaker. However, the engine controller 50 may be configured to notify the operator of the machine 20 in other ways using the operator interface 34.

Throughout all modes 66 of operation for the at least one pump 36, the operator of the machine 20 may shut down the pump motor 44 via manual activation of a safety shutdown switch 78 (FIG. 2) of the fuel system 28. For example, the pump controller 46 may include the safety shutdown switch 78 which is in communication with the operator interface 34, although other configurations for the safety shutdown switch 78 may be used. The safety shutdown switch 78 may be configured to shut down the pump motor 44 upon receiving signals indicative of operator input from the operator interface 34.

For instance, the operator interface 34 may include an operator control, such as a button, switch, or lever, configured to receive operator input and send signals indicative of the same to the pump controller 46. Once the operator of the machine 20 safely parks the machine 20, the at least one pump 36 may be shut down by manually activating the operator control connected to the safety shutdown switch 78, such as before the timer expires or before the backup battery 56 is depleted. In so doing, the operator of the machine 20 may override programming in the pump controller 46 to shut down the at least one pump 36.

Figure 4:
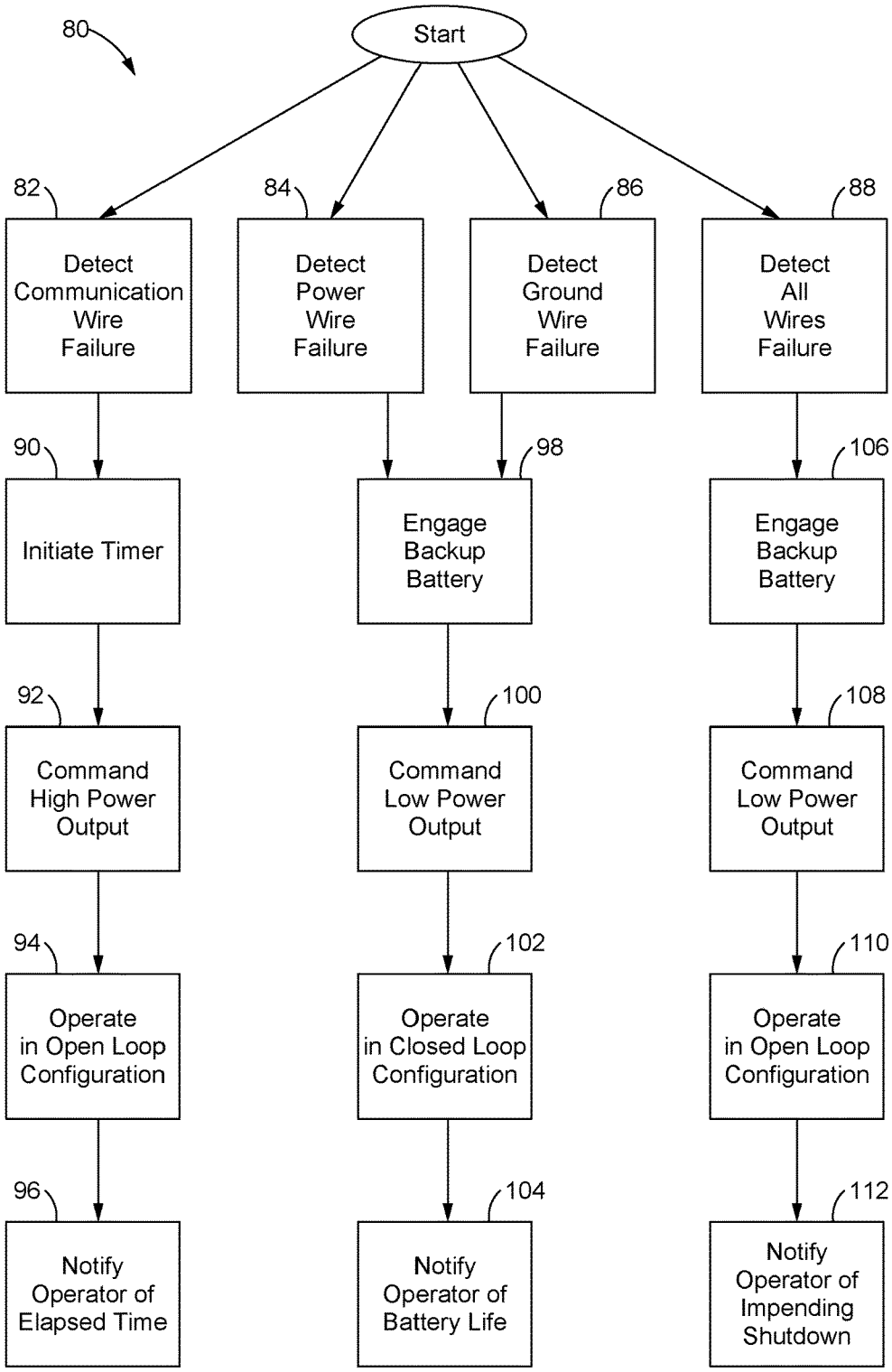
FIG. 4 is a flowchart illustrating an example process or algorithm for controlling the fuel system of FIG. 2, in accordance with another aspect.

Turning now to FIG. 4, with continued reference to FIGS. 1-3, an example flowchart 80 illustrating an example process or algorithm for controlling the fuel system 28 of the machine 20 is shown, in accordance with one aspect of the present disclosure. At least part of the process may be programmed into or stored in the memory 48 of the pump controller 46 and the memory 52 of the engine controller 50. At block 82, the communication wire failure may be detected. At block 84, the power wire failure may be detected. At block 86, the ground wire failure may be detected. At block 88, the all wires failure may be detected.

Upon detection of the communication wire failure, the timer may be initiated at block 90. The timer may be preprogrammed into the memory 48 of the pump controller 46. At block 92, the predetermined high power output may be commanded to the pump motor 44, the predetermined high power output preprogrammed into the memory 48 associated with the pump controller 46. At block 94, the pump motor may be operated in the open loop configuration in which the pump motor 44 is set at a default speed preprogrammed into the memory 48 associated with the pump controller. The operator of the machine 20 may be notified of the elapsed time of the timer at block 96.

Upon detection of one of the power wire failure or the ground wire failure, the backup battery 56 may be engaged to supply power to the pump motor 44, at block 98. At block 100, the predetermined low power output may be commanded to the pump motor 44, the predetermined low power output being less than the predetermined high power output and preprogrammed into the memory 48 associated with the pump controller 46. At block 102, the pump motor may be operated in the closed loop configuration in which the speed of the pump motor 44 is modified based on feedback indicative of the actual fuel pressure of the at least one pump 36. The operator of the machine 20 may be notified of the battery life of the backup battery 56 at block 104.

Upon detection of the all wires failure, the backup battery 56 may be engaged to supply power to the pump motor 44, at block 106. At block 108, the predetermined low power output may be commanded to the pump motor 44. At block 110, the pump motor may be operated in the open loop configuration. The operator of the machine 20 may be notified of the impending shutdown at block 112.

In general, the foregoing disclosure finds utility in various industrial applications, such as, in earthmoving, construction, industrial, agricultural, mining, transportation, and forestry machines. In particular, the disclosed hydraulic system may be applied to excavators, loaders, earth-moving vehicles, dozers, motor graders, tractors, backhoes, trucks, mining vehicles, on-highway vehicles, trains, generator sets, agricultural equipment, material handling equipment, and the like.

By applying the disclosed fuel system to a machine, uninterrupted power supply to an electric fuel pump may be provided in the event of a wiring harness failure. More specifically, the disclosed pump controller and engine controller are each configured to detect different types of wiring failures, such as failures of the communication, power, and ground wires. Based on the type of wiring failure, the disclosed fuel system may selectively engage a backup battery, operate at a low power output, operate in an open loop configuration, and/or initiate a timer to shut down the fuel pump. In so doing, the uninterrupted power supply during the event of a wiring failure may allow the machine operator sufficient time to safely park the machine and shut down the pump for repair.

While the foregoing detailed description has been given and provided with respect to certain specific embodiments, it is to be understood that the scope of the disclosure should not be limited to such embodiments, but that the same are provided simply for enablement and best mode purposes.

The breadth and spirit of the present disclosure is broader than the embodiments specifically disclosed and encompassed within the claims appended hereto. Moreover, while some features are described in conjunction with certain specific embodiments, these features are not limited to use with only the embodiment with which they are described, but instead may be used together with or separate from, other features disclosed in conjunction with alternate embodiments.

What is claimed is:

1. A fuel system for a machine, comprising:

a fuel pump;

a pump motor configured to drive the fuel pump; and a pump controller operatively connected to the pump motor, a main battery bank of the machine via a power wire and a ground wire, and an engine controller of the machine via a communication wire, the pump controller configured to:

detect a failure of at least one of the communication wire, the power wire, and the ground wire, and adjust a power output and an operation of the pump motor based on the detected failure of at least one of the communication wire, the power wire, and the ground wire.

2. The fuel system of claim 1, wherein, if the detected failure is associated with the communication wire, the pump controller is further configured to command a predetermined high power output to the pump motor, the predetermined high power output preprogrammed into a memory associated with the pump controller.

3. The fuel system of claim 2, wherein if the detected failure is associated with the communication wire, the pump controller is further configured to operate the pump motor in an open loop configuration in which the pump motor is set to a default speed preprogrammed into the memory associated with the pump controller.

4. The fuel system of claim 3, wherein if the detected failure is associated with the communication wire, the pump controller is further configured to initiate a timer preprogrammed into the memory associated with the pump controller, and shut down the pump motor upon expiration of the timer.

5. The fuel system of claim 1, further comprising a backup battery operatively connected to the pump controller, and wherein if the detected failure is associated with one of the power wire or the ground wire, the pump controller is further configured to engage the backup battery to supply power to the pump motor.

6. The fuel system of claim 5, wherein if the detected failure is associated with one of the power wire or the ground wire, the pump controller is further configured to command a predetermined low power output to the pump motor, the predetermined low power output preprogrammed into a memory associated with the pump controller.

7. The fuel system of claim 6, wherein if the detected failure is associated with one of the power wire or the ground wire, the pump controller is further configured to operate the pump motor in a closed loop configuration in which the engine controller is configured to receive feedback indicative of an actual fuel pressure and send signals to the pump controller to modify a speed of the pump motor based on the received feedback.

8. The fuel system of claim 7, wherein if the detected failure is associated with one of the power wire or the ground wire, the pump controller is further configured to send a signal to the engine controller indicative of a battery life of the backup battery.

9. The fuel system of claim 1, wherein if the detected failure is associated with each of the communication wire, the power wire, and the ground wire, the pump controller is further configured to engage a backup battery to supply power to the pump motor, command a predetermined low power output to the pump motor, and operate the pump motor in an open loop configuration.

10. The fuel system of claim 1, wherein the pump controller includes a safety shutdown switch in operative communication with an operator interface, the safety shutdown switch configured to shut down the pump motor upon receiving signals from the operator interface indicative of operator input.

11. A machine, comprising:

an engine;

an engine controller operatively connected to the engine;

a main battery bank operatively connected to the engine controller and operatively charged by the engine; and a fuel system in operative communication with the engine, the fuel system including:

a backup battery, a fuel pump operatively configured to deliver pressurized fuel to the engine, a pump motor powered primarily by the main battery bank and configured to drive the fuel pump, and a pump controller operatively connected to the backup battery, the pump motor, the engine controller via a communication wire, and the main battery bank via a power wire and a ground wire, the pump controller configured to:

detect a failure of at least one of the communication wire, the power wire and the ground wire, engage the backup battery to supply power to the pump motor if the detected failure is associated with one of the power wire or the ground wire, and selectively adjust a power output and an operation of the pump motor based on the detected failure of at least one of the communication wire, the power wire, and the ground wire.

12. The machine of claim 11, wherein the pump controller is further configured to, if the detected failure is associated with the communication wire:

command a predetermined high power output to the pump motor, the predetermined high power output preprogrammed into a memory associated with the pump controller, operate the pump motor in an open loop configuration in which the pump motor is set at a default speed preprogrammed into the memory associated with the pump controller, initiate a timer preprogrammed into the memory associated with the pump controller, and shut down the pump motor upon expiration of the timer.

13. The machine of claim 11, wherein the pump controller is further configured to, if the detected failure is associated with one of the power wire or the ground wire:

command a predetermined low power output to the pump motor, the predetermined low power output preprogrammed into the memory associated with the pump controller, operate the pump motor in a closed loop configuration in which the engine controller is configured to receive feedback indicative of an actual fuel pressure and send signals to the pump controller to modify a speed of the pump motor based on the received feedback, and send signals to the engine controller indicative of a battery life of the backup battery, the engine controller operatively configured to notify an operator of the machine of the battery life via an operator interface.

14. The machine of claim 11, wherein the pump controller is further configured to, if the detected failure is associated with each of the communication wire, the power wire, and the ground wire:

engage the backup battery to supply power to the pump motor, command a predetermined low power output to the pump motor, operate the pump motor in an open loop configuration, and send signals to the engine controller indicative of a battery life of the backup battery, the engine controller operatively configured to notify an operator of the machine of the battery life via an operator interface.

15. The machine of claim 11, further comprising an operator control operatively connected to the pump controller, the operator control configured to receive input from an operator of the machine to shut down the fuel pump and send signals indicative of the same to the pump controller, and wherein the pump controller is further configured to shut down the pump motor upon receiving the signals from the operator control.

16. The machine of claim 11, wherein the pump controller is further configured to recharge the backup battery using power supplied by the main battery bank.

17. The machine of claim 16, wherein the backup battery comprises a lithium-ion battery.

18. A method for controlling a fuel system of a machine in an event of a wiring harness failure, the fuel system including a backup battery, a fuel pump, a pump motor configured to drive the fuel pump, and a pump controller operatively connected to the backup battery, the pump motor, an engine controller of the machine via a communication wire, and a main battery bank of the machine via a power wire and a ground wire, the method being performed by at least one of the pump controller and the engine controller, and comprising:

detecting one or more of a communication wire failure, a power wire failure, a ground wire failure, and an all wires failure;

upon detection of the communication wire failure, commanding a predetermined high power output to the pump motor, the predetermined high power output preprogrammed into a memory associated with the pump controller;

upon detection of one of the communication wire failure or the all wires failure, operating the pump motor in an open loop configuration in which the pump motor is set at a default speed preprogrammed into the memory associated with the pump controller;

upon detection of the communication wire failure, initiating a timer preprogrammed into the memory associated with the pump controller;

upon detection of the communication wire failure, shutting down the pump motor after expiration of a timer;

upon detection of one of the power wire failure, the ground wire failure, or the all wires failure, engaging the backup battery to supply power to the pump motor;

upon detection of one of the power wire failure, the ground wire failure, or the all wires failure, commanding a predetermined low power output to the pump motor, the predetermined low power output being less than the predetermined high power output and preprogrammed into the memory associated with the pump controller;

upon detection of one of the power wire failure or the ground wire failure, operating the pump motor in a closed loop configuration in which a speed of the pump motor is modified based on feedback indicative of an actual fuel pressure; and upon detection of one of the power wire failure or the ground wire failure, notifying the operator of the machine of a battery life of the backup battery.

19. The method of claim 18, further comprising shutting down the pump motor upon receiving signals from an operator control configured to receive input from the operator of the machine.

20. The method of claim 19, further comprising commanding the predetermined high power output and operating the pump in the closed loop configuration during normal operation of the machine.

* * * * *